US010215190B2

(12) United States Patent
Augy et al.

(10) Patent No.: US 10,215,190 B2
(45) Date of Patent: Feb. 26, 2019

(54) REFRIGERANT COMPRESSING PROCESS WITH COOLED MOTOR

(71) Applicant: GE Oil & Gas, Inc., Houston, TX (US)

(72) Inventors: Philippe Augy, Le Creusot (FR); Shukui Zhao, Houston, TX (US); David Kennedy, Schertz, TX (US); Pierre Laboube, Le Creusot (FR); Ravikumar Vipperla, Schertz, TX (US)

(73) Assignee: GE Oil & Gas, Inc., Houston, TX (US)

( * ) Notice: Subject to any disclaimer, the term of this patent is extended or adjusted under 35 U.S.C. 154(b) by 245 days.

(21) Appl. No.: 15/169,123

(22) Filed: May 31, 2016

(65) Prior Publication Data

US 2017/0343012 A1 Nov. 30, 2017

(51) Int. Cl.

| | |
|---|---|
| ***F04D 29/58*** | (2006.01) |
| ***F04D 17/12*** | (2006.01) |
| ***F04D 19/02*** | (2006.01) |
| ***F25J 1/00*** | (2006.01) |
| ***F25J 1/02*** | (2006.01) |

(52) U.S. Cl.

CPC ..... *F04D 29/5806* (2013.01); *F04D 17/12* (2013.01); *F04D 19/02* (2013.01); *F04D 29/5826* (2013.01); *F25J 1/0022* (2013.01); *F25J 1/0055* (2013.01); *F25J 1/0236* (2013.01); *F25J 1/0279* (2013.01); *F25J 1/0284* (2013.01); *F25J 2230/22* (2013.01)

(58) Field of Classification Search

CPC .... F04D 29/58; F04D 29/5806; F04D 29/582; F04D 29/5826

USPC ..... 417/367, 369, 370, 234, 251, 423.5

See application file for complete search history.

(56) References Cited

U.S. PATENT DOCUMENTS

| | | | | |
|---|---|---|---|---|
| 2,888,193 | A * | 5/1959 | Greenwald | F04D 25/0606 415/175 |
| 6,390,789 | B1 * | 5/2002 | Grob | F04D 17/12 417/251 |
| 9,200,643 | B2 * | 12/2015 | Gilarranz | F04D 25/0606 |
| 2007/0018516 | A1 * | 1/2007 | Pal | F04D 25/082 310/61 |
| 2007/0212232 | A1 * | 9/2007 | De Larminat | F04C 29/045 417/83 |
| 2009/0044548 | A1 * | 2/2009 | Masoudipour | F04D 17/122 62/115 |
| 2015/0064026 | A1 * | 3/2015 | Maier | F04D 17/122 417/53 |
| 2016/0305551 | A1 | 10/2016 | Koop et al. | |

FOREIGN PATENT DOCUMENTS

EP 2456979 B1 12/2016

* cited by examiner

*Primary Examiner* — Charles G Freay

(74) *Attorney, Agent, or Firm* — Mintz Levin Cohn Ferris Glovsky and Popeo, P.C.

(57) ABSTRACT

A cooling system is provided for cooling a motor that drives a compressor in a liquefaction system. The coolant used for cooling the motor includes portions of a discharge from a compressor. The coolant for the motor is generated from a vapor component of the discharge from the compressor. The discharge from the compressor is cooled and the vapor component is separated from a liquid component and treated prior to being introduced into the motor. Remaining portions of the discharge from the compressor are routed to cold boxes producing a compressed refrigerant.

14 Claims, 7 Drawing Sheets

REFRIGERANT COMPRESSING PROCESS WITH COOLED MOTOR

FIELD

The subject matter disclosed herein relates to liquefaction systems and processes, and in particular to systems and methods for cooling a motor used in a liquefaction process.

BACKGROUND

Liquefied natural gas, referred to in abbreviated form as "LNG," is a natural gas which has been cooled to a temperature of approximately −162 degrees Celsius with a pressure of up to approximately 25 kPa (4 psi) and has thereby taken on a liquid state. Most natural gas sources are located a significant distance away from the end-consumers. One cost-effective method of transporting natural gas over long distances is to liquefy the natural gas and to transport it in tanker ships, also known as LNG-tankers. The liquid natural gas is transformed back into gaseous natural gas at the destination.

In a typical liquefaction process a compressor is used to deliver pressurized refrigerant to a cold box, which in turn is used to cool a feedgas, such as a natural gas, to form a liquefied gas. The compressor is typically driven by a motor. Most motors need to be cooled and that may limit the maximum power that the motor can generate. Cooling a motor requires energy and resources which can be expensive and can take up considerable space. Therefore, there is a need for methods and processes for improving the cooling of a motor that drives a compressor that is used in a liquefaction process.

SUMMARY

Methods and systems are provided for cooling a motor that drives a compressor which compresses a refrigerant (hereinafter "refrigerant" or "mixed refrigerant") that is used to cool a cold box, thereby allowing the cold box to liquefy a feedgas, such as a natural gas. Thus, in one embodiment, a motor is cooled using at least a portion of refrigerant that is discharged from a compressor. In some variations, the discharged refrigerant ("discharge") exiting a stage of a multi-stage compressor can include a vapor component and a liquid component. At least a portion of the discharge can be passed to a cooler that is configured to cool the discharged refrigerant, e.g., to a temperature in a range of about 3-55 degrees Celsius. The cooled discharged refrigerant can be passed through a condenser, which can separate the vapor component of the discharged refrigerant from the liquid component of the discharged refrigerant. The liquid component of the discharge can be diverted to a cold box for downstream processing. At least a portion of the vapor component of the discharge can be used as a gaseous coolant to cool the motor. In some variations, a remaining portion of the vapor component that is not used to cool the motor can be passed to another stage of the multi-stage compressor for further compressing.

In another embodiment, a system is provided and includes a compressor having a plurality of stages. The compressor can be configured to process a refrigerant to cool a motor coupled to the compressor. The refrigerant can include only a single gas or a mixture of at least two gases ("mixed refrigerant"). The motor coupled to the compressor is configured to drive the compressor. In one embodiment, the system is configured to cool a portion of a refrigerant discharged from a stage of the plurality of stages of the compressor. By cooling a portion of the discharged refrigerant, a vapor is produced and is delivered to the motor for cooling the motor. A refrigerant discharged from a stage of the plurality of stages of the compressor can include gas that has been compressed by the compressor. At least a portion of the gas that has been compressed by the compressor can be in liquid form.

The system can have a variety of configurations, and in one embodiment the system can include a cooler and a separator configured to facilitate separation of a liquid and the vapor from the discharged refrigerant received from the stage of the plurality of stages of the compressor. In an exemplary embodiment, the cooler is configured to cool the discharged refrigerant to a temperature in the range of about 3-55 degrees Celsius.

In some variations, the cooler and separator can be two units. In other variations, the cooler and separator can be integrated, forming a single unit. The cooler can be a heat exchanger, which can include air cooling, water cooling, and/or cooling with one or more other fluids. The separator can be a two-phase separator, wherein the liquid component of the discharged refrigerant can be removed from the bottom of a vessel of the separator and the vapor component of the discharged refrigerant can be removed from the top of the vessel of the separator.

In other aspects, the system can include a cold box configured to perform down-stream processing of the liquid.

The system can also include a second cooler configured to cool the vapor to remove liquid from the vapor and form a gaseous coolant to be delivered to the motor for cooling the motor. The system can further include a cold box configured to receive a liquid produced by the second cooler.

In other aspects, the system can include a motor discharge cooler configured to cool motor discharge from the motor that drives the compressor. The motor discharge can include at least a portion of the gaseous coolant delivered to the motor for cooling.

In another embodiment, the discharge of refrigerant from the compressor can be discharged from a second stage of the plurality of stages of the compressor. In yet other aspects, the discharge from the compressor can be discharged from a first stage of the plurality of stages of the compressor.

In another embodiment, the motor can include an outlet for discharging at least a portion of the gaseous coolant delivered to the motor for cooling the motor. A first stage of the plurality of stages of the compressor can include an inlet configured to receive the discharge from the motor. The motor can also include a fan configured to increase a pressure of the gaseous coolant delivered to the motor for cooling the motor, and a second stage of the plurality of stages of the compressor can include an inlet configured to receive the discharge from the motor.

In other aspects, a Joule Thompson valve or water cooler is used to cool the gaseous coolant for delivery to the motor.

Methods for cooling a motor driving a compressor are also provided and in one embodiment the method includes cooling discharge from a stage of a compressor having a plurality of stages, the discharge having a liquid component and a vapor component. The method can further include separating the vapor component from the liquid component, cooling at least a portion of the vapor component of the discharge to form a gaseous coolant, and delivering the gaseous coolant to a motor that drives the compressor to thereby cool the motor. Cooling the at least a portion of the vapor component of the discharge to form the gaseous coolant can include cooling the at least a portion of the vapor component of the discharge to a temperature in a range of about 3-55 degrees Celsius.

In one aspect, the method can include sending the liquid component of the discharge to a cold box. The liquid component of the discharge can be a mixed refrigerant.

In other aspects, the method can include receiving motor discharge from the motor that drives the compressor, the motor discharge including a gaseous coolant that has passed through the motor. The method can further include cooling the motor discharge to form a vapor component and a liquid component, and sending the liquid component of the motor discharge to a cold box.

In another embodiment, the method can include receiving motor discharge from the motor that drives the compressor, the motor discharge including a gaseous coolant that has passed through the motor. The method can further include introducing the motor discharge into a stage of the compressor.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Various exemplary systems, devices, and methods are provided for cooling a motor for driving a compressor that compresses a refrigerant. The various exemplary systems, devices, and methods use discharged refrigerant, from one or more stages of a two-stage compressor used for compressing the refrigerant, to cool the motor that drives the compressor. Embodiments of the subject matter disclosed herein are useful and applicable to industry for a number of reasons. For example, it has been discovered that using a compressor's discharge to cool a motor that drives a compressor can increase the yield of the compression system itself. The systems, devices, and methods disclosed herein also produce a number of additional advantages and/or technical effects.

Figure 1:
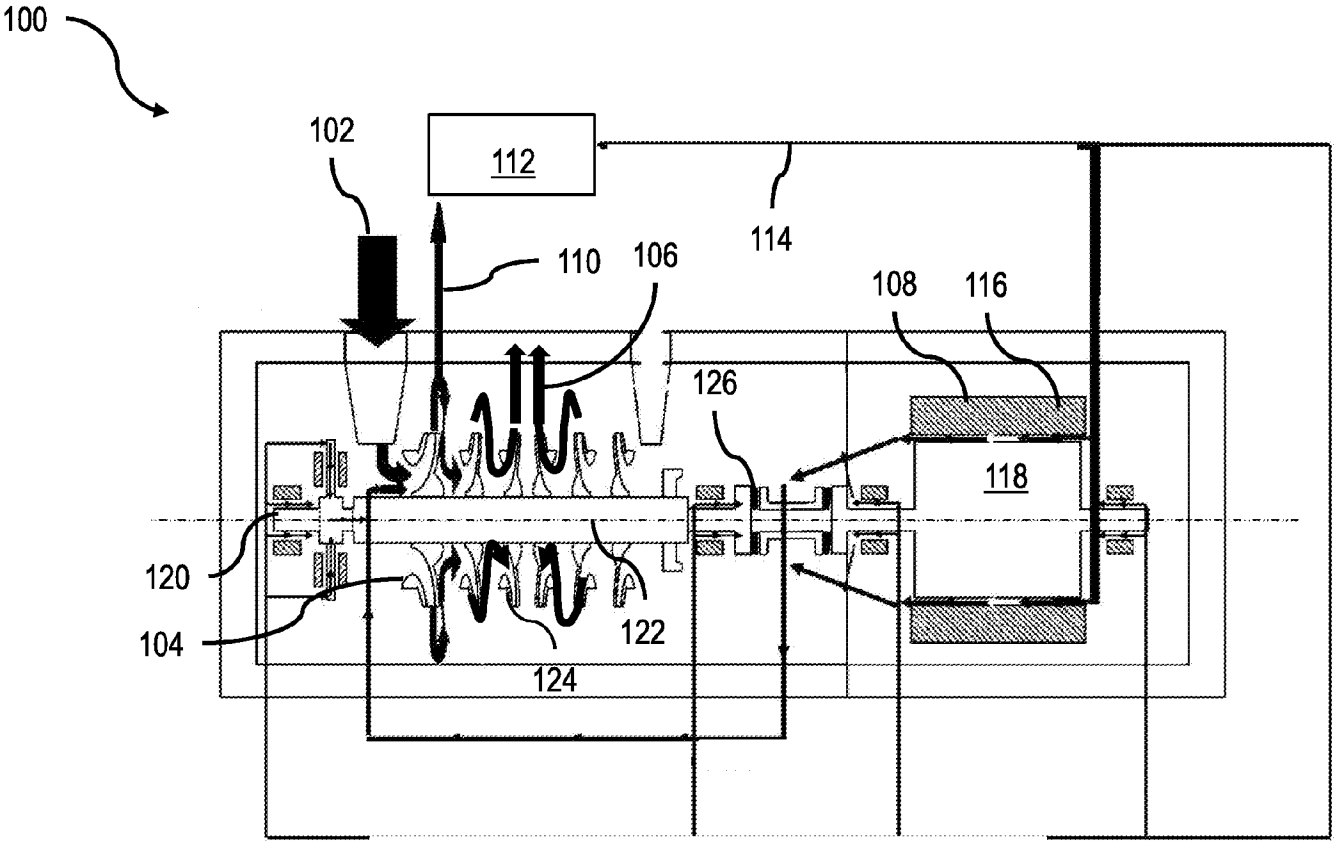
FIG. 1 is a schematic diagram of one embodiment of a refrigerant compression system.

FIG. 1 is an illustration of a refrigerant compression system 100 that includes a compressor 104 and a motor 108 for driving the compressor 104. Refrigerant for facilitating the condensation of a feedgas into a liquefied gas can be compressed using the refrigerant compression system 100. Compressed refrigerant 106 discharged from the compressor 104 can be provided to a cold box (not shown) where a feedgas is condensed into a liquefied gas. In one example, the feedgas can be or can include a natural gas, and the cold box can be configured to cool the natural gas into liquefied natural gas ("LNG"). The compressed refrigerant 106 aids in this liquefaction process by expanding, causing the refrigerant 106 to cool and draw heat from the feedgas, condensing the feedgas into liquefied gas. The expanded and heated refrigerant, shown in FIG. 1 as the returning refrigerant 102, can return from the cold box to be recompressed by the compression system 100 to form a compressed refrigerant 106. The compressed refrigerant 106 is cycled back to the cold box to continue condensing of the feedgas.

Driving the compressor 104 causes the motor 108 to heat up, but it has been advantageously discovered that the motor 108 can be cooled using at least a portion of the refrigerant discharged from the compressor 104, hereinafter "discharged refrigerant 110". In some variations, a stage of a multi-stage compressor can discharge a refrigerant, which can include a vapor component and a liquid component, and at least a portion of the discharged refrigerant 110 can be cooled. For example, the discharged refrigerant 110, including the vapor component and the liquid component can be passed to a cooler (described below) that cools the discharged refrigerant 110 to a temperature in a range of about 3-55 degrees Celsius. The cooled, discharged refrigerant 110 can also be passed through a condenser (described below) and separator which separates the vapor component and liquid component of the discharged refrigerant 110. Subsequently, the liquid component of the discharged refrigerant 110 can be diverted to a cold box to facilitate liquefaction of a feed gas, while at least a portion of the vapor component of the discharged refrigerant 110 is used as a gaseous coolant to cool the motor 108. In some variations, a portion of the vapor component of the discharged refrigerant 110 remaining after cooling the motor 108, or not used for cooling the motor 108, can be passed to another stage of the two-stage compressor for further compressing.

As shown in FIG. 1, the discharged refrigerant 110 extracted from the compressor 104 can be passed through one or more filters 112. The discharged refrigerant 110 can then be introduced into the motor 108. The discharged refrigerant 110 can travel from the compressor 104 to the motor 108 through one or more pipes 114. The flow of the discharged refrigerant 110 can be provided by a pressure gradient. The pressure within the pipe(s) 114 at the compressor 104 can be greater than the pressure within the pipe(s) 114 at the motor 108, causing flow of the discharged refrigerant 110 in a direction away from the compressor 104 and toward the motor 108. When the discharged refrigerant 110 enters the motor 108, the discharged refrigerant 110 can follow the path of least resistance through the motor 108. In some variations, the motor 108 may be configured to allow the discharged refrigerant 110, which at this stage is primarily a vapor, to flow freely through the motor 108, motor windings 116, a rotor 118, or the like. In some variations, the discharged refrigerant 110 may be configured to travel through one or more bearings of the motor 108.

In some variations, the motor 108 may include a series of pipes of channels disposed within the windings 116 and/or rotor 118. The discharged refrigerant 110 can flow through the channels. The discharged refrigerant 110 is cooler than the elements of the motor 108 and can thereby facilitate cooling of the motor 108.

Figure 2:
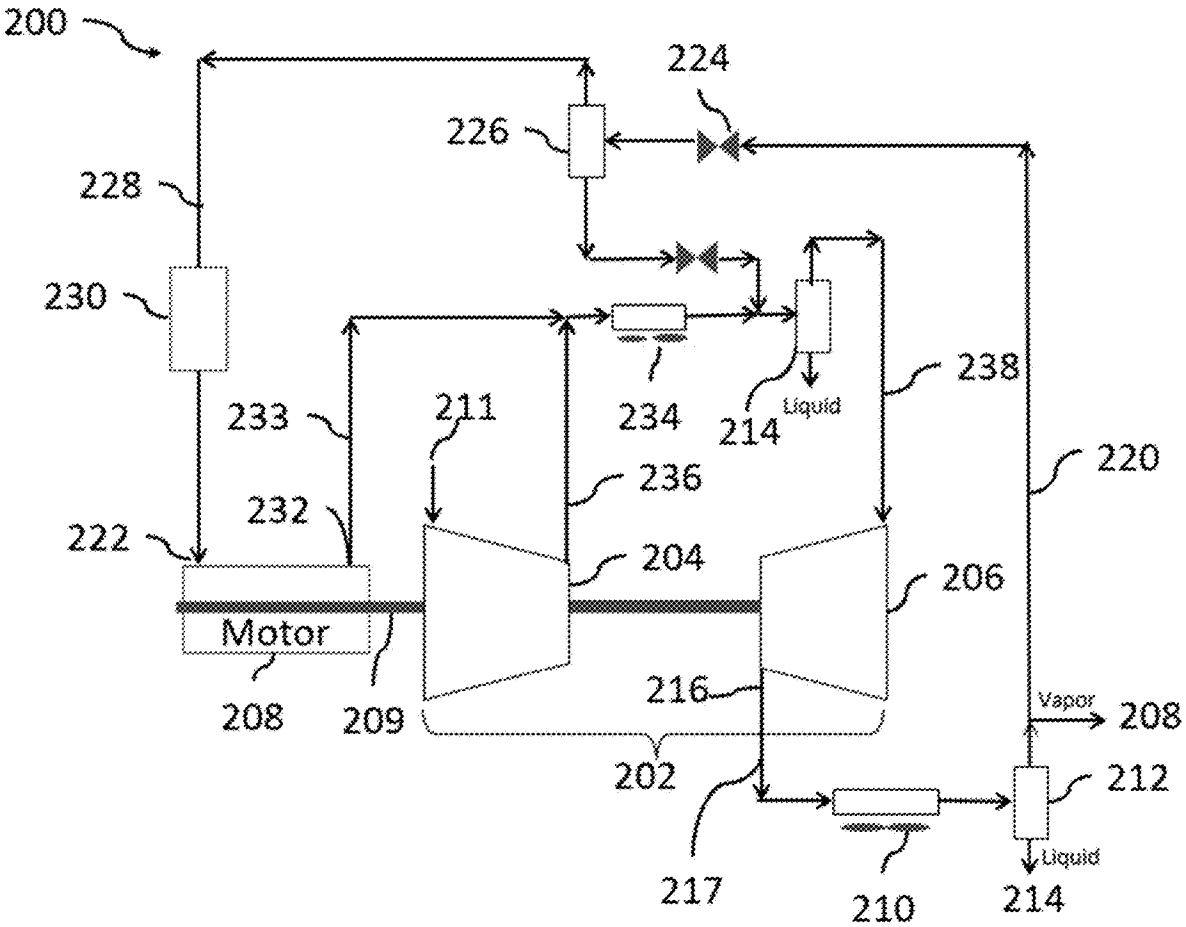
FIG. 2 is a schematic diagram of one embodiment of a gas processing system with a cooled motor for maximizing production.

FIG. 2 is a schematic diagram of one embodiment of a gas compression processing system 200 having a motor that is cooled. The illustrated system 200 includes a two-stage compressor 202 having a first stage 204 and a second stage 206. The two-stage compressor 202 shown in FIG. 2 is for illustrative purposes only. The presently described or claimed subject matter can be applied to a compressor having any number of stages.

In some variations, the first stage 204 is configured to compress incoming refrigerant to a first pressure. The refrigerant passes to the second stage 206 which further compresses the refrigerant. This refrigerant is then discharged from the second stage 206 as discharged refrigerant or discharge 217. In some variations, the compressor 202 can include an interstage cooler. The discharge 217 is sent to a cold box to facilitate cooling of a feedgas. If the incoming feedgas that will be cooled by or within the cold box is natural gas, for example, the cold box will produce liquefied natural gas, or LNG. This or a similar process can be used for liquefying other hydrocarbon gases such as ethane, propane, and other hydrocarbons.

The two-stage gas compressor 202 can be a seal-less integrated motor compressor, for example an integrated compressor line (ICL) with the motor and compressor in a single casing. Other multi-stage compressors are contemplated by the presently described subject matter. The compressor 202 can be driven by a motor 208. In some variations, the motor 208 can be an electric induction motor. The two-stage gas compressor 202 can be a centrifugal gas compressor, which can include multiple impellers.

The horsepower of the motor 208 is typically limited by the ability to cool the motor. Accordingly, portions of the compressed refrigerant produced by the compressor 302 can be used to cool the motor 208 by introducing the compressed refrigerant directly into the motor 208. The portions of the refrigerant introduced into the motor 208 can be a vapor component of the compressed refrigerant that flows through the motor. As explained above with respect to FIG. 1, a pipe can carry at least a portion of the refrigerant from the compressor 202 to the motor 208. The motor 208 can have a larger volume than the pipe extending between the compressor 202 and the motor 208, thereby causing a reduction in pressure at the motor 208. The pressure gradient caused by the different pressures can cause the vapor component to flow from the compressor 202 to the motor 208. The pressure gradient can also cause the refrigerant to flow through the components of the motor 208, such as the windings and the stator, and back to the compressor 202. Also, compared to ICL compressors, other compressors can have significant leakage of refrigerant.

One or more one-way valves can be disposed in the pipe(s) between the compressor 202 and the motor 208. The one-way valves can be configured to prevent backflow of the refrigerant.

The motor 208 can be connected to a shaft 209, which may impart mechanical energy from the motor 208 to the compressor 202. The shaft 209 can couple the motor 208 and compressor 202 so that they rotate together on a common drive train. In one example, as illustrated in FIG. 1, the multi-stage ICL compressor 104 has a rotor 120 that includes a shaft 122 on which multiple impellers 124 can be stacked. The rotor 120 can be connected to the motor 108 through a flexible coupling 126. Referring back to FIG. 2, the motor 208 may be any type of motor, such as a brushless electric motor, brushed electric motor, a DC motor, a synchronous AC motor, an asynchronous AC motor, a magnetic electric motor, an electrostatic electric motor, a piezoelectric motor, self-commutated, externally commutated, a linear motor, a permanent magnet motor, an induction motor, or the like. The motor 208 can include one or more motors.

In some variations, the motor 208 may be a high-speed electric motor. The motor can be an induction motor or a permanent magnet synchronous motor. The electric motor 208 and the compressor 202 may be located within a motor-compressor casing (not shown). The speed of the motor 208 can be controlled via a variable speed drive system (not shown). Both rotors of the motor and the compressor can be sustained by oil free bearings such as magnetic bearings or gas bearings. One or more internal casings and separators may be disposed within the motor-compressor casing.

The compressor 202 can be in fluid communication with the refrigerant feed 211. The compressor 202 may be an axial compressor, radial compressor, axial-radial compressor or the like. The refrigerant feed 211 can provide a supply of refrigerant to the compressor 202. The refrigerant can be formed from one or more types of hydrocarbons and/or other components. An example of a refrigerant for use with the presently described system can include natural gas, nitrogen, or other types of gas for which compression may be necessary to facilitate cooling in a cold box. The compressor 202 can be in fluid communication with a refrigerant outlet 216, through which compressed refrigerant 217 may exit the compressor 202. The refrigerant feed 211 can include uncompressed refrigerant returning from a cold box.

The system 200 can include an after cooler 210. The after cooler 210 can be a liquid cooler (including water), air cooler, or the like. Being part vapor and part liquid, the discharged refrigerant 217 from the second stage 206 of the multi-stage compressor 202 can be passed through the after cooler 210 to cool the discharged refrigerant 217. In some variations, the cooler can be configured to cool the liquefied component and the vapor component of the discharged refrigerant 217 from the outlet of the compressor to a temperature in the range of about 3-55 degrees Celsius.

The condenser 212, which can form part of the system 200, operates to separate the liquid component and the vapor component of the discharged refrigerant 217. The liquid component of the discharged refrigerant 217 can be diverted to a cold box(s) 214, and the vapor component of the discharged refrigerant 217 can be diverted to the motor 208 and used to cool the motor 208. The discharged refrigerant 217 exiting the multi-stage compressor 202 from the refrigerant outlet 216 is compressed. The cold box 214 can be configured to facilitate down-stream processing of the compressed refrigerant 217.

The motor 208 may heat while it is driving the compressor 202. Due to the heat of the motor 208, the power of the motor 208 may cause the motor to work less effectively at driving the compressor 202. Consequently, the motor 208 needs to be cooled.

Accordingly, the motor 208 can be cooled using at least a portion of a vapor component of the discharged refrigerant 217 that exits an outlet 216 of a stage of the multi-stage compressor 202, instead of sending the vapor component to the cold box 214 together with the liquid component. Furthermore, using at least a portion of the vapor component of the discharged refrigerant 217 to cool the motor 208 negates the need for a separate motor coolant system to cool the motor 208.

The outlet 216 can be disposed after the second stage 206 of the two-stage compressor. In other variations, the outlet 216 can be disposed between the first stage 204 and the second stage 206 of the two-stage compressor 202.

At least a portion of the vapor component 220 that has been separated from the liquid component of the discharged refrigerant 217 by the separator 212 can be used to cool the motor 208. The motor 208 can include a refrigerant inlet 222 for receiving at least a portion of the vapor component 220 of the discharged refrigerant 217. A remaining portion of the vapor component 220 of the discharged refrigerant 217 can be passed to a cold box 214.

The system 200 can include a cooling device 224 that is configured to cool the vapor component 220 of the discharged refrigerant 217 from the compressor 202. The cooling device can be disposed in a pipe between the compressor 302 and the motor 308. In some variations, the cooling device 224 can be a Joule-Thomson valve. A Joule-Thomson valve can be configured to facilitate the expansion of the vapor component 220 of the discharged refrigerant 217, largely a gas, through a throttling device. The throttling device can be a valve. No external work is extracted from the vapor component 120 during expansion. During the expansion, enthalpy will remain unchanged.

In an exemplary embodiment, the device 224 can be configured to cool the vapor component 220 of the discharged refrigerant 217 from the compressor 202 to a temperature in a range of about 3-50 degrees Celsius. A second separator 226 can accompany the device 224. The second separator 226 can be configured to refine the vapor component 220 of the discharged refrigerant 217 by further separating from it at least a portion of any remaining liquid. At least a portion of the remaining liquid can ultimately be passed on for down-stream processing, for example, to a cold box 214. Liquid can damage the motor 208, especially when the motor 208 is an electric motor. Consequently, liquid components of the discharged refrigerant 217 are preferably removed prior to a discharged and compressed refrigerant 217 entering the motor 208. Similarly, the presently described system 200 can be configured to remove as much liquid as possible from the gaseous coolant prior to being used to cool the motor 208.

After traversing the device 224 the vapor component 220 of the discharged refrigerant 217 can be used as the gaseous coolant 228 for cooling the motor 208, as described above. The gaseous coolant 228 can be passed through a coolant inlet 222 of the motor 208. The gaseous coolant 228 can flow from the cooling device 224 into the motor 208. The gaseous coolant 228 can flow through any cavities within the motor 208. Being gaseous, the gaseous coolant 228 can flow directly through the windings, stator, and other components of the motor 208. Between the separator 226 and the motor 208, and thus "upstream of the motor 208," a filter 230 can be configured to filter contaminants from the coolant gas 228.

In some variations, the device 224 and/or second separator 226 can be configured to ensure that a pressure of the coolant gas 228 is optimized for providing sufficient cooling effect to the motor. In some variations, a pressure regulator can be incorporated between the device 224 and/or the second separator 226 and the motor 208. The pressure of the coolant entering the motor can be regulated to a range between about 5-80 bar. The temperature of the coolant can be in a range of about 3-55 degrees Celsius. Providing the coolant at higher pressure increases the heat transfer which enhances the cooling of the motor 208. At pressures close to atmospheric pressure the heat transfer is relatively low and hence the motor is not cooled adequately. As pressure of the gaseous coolant 228 increases, the cooling efficiency of the gaseous coolant 228 on the motor 208 increases. After a certain pressure, any increase to the pressure provides insignificant gain to cooling efficiency. Consequently, the compressor 202 can be configured to pressurize the refrigerant to a pressure in the range of about 40-80 bar.

The motor 208 can include a gaseous coolant outlet 232. The gaseous coolant outlet 232 can be configured to permit the coolant 228 to exit the motor 208 having passed through the motor 208 and cooled the motor 208. Consequently, the discharged gaseous coolant 233 from the coolant outlet 232 will be hotter than the gaseous coolant 228 entering the motor 208 at inlet 222.

The system 200 can include another cooler 234. The cooler 234 can be a motor discharge cooler. The cooler 234 can be configured to cool discharged coolant 233 from the motor 208. The discharged coolant 233 can have a liquid component and a vapor component. Subsequent to being cooled by the cooler 234, the liquid component can be diverted to a cold box 214 for downstream processing. The liquid component of the discharged coolant 233 is preferably sufficiently cooled for transport to a downstream processing apparatus. The vapor component of the discharged coolant 233 can be routed to the second stage 206 of the two-stage compressor for further compression.

In some variations, the first stage 204 of the multi-stage compressor 202 can include a discharge outlet 236. The discharged refrigerant from the first stage 204 of the multi-stage compressor 202 can be passed to the cooler 234. The cooler 234 can be configured to cool the discharged refrigerant received from the first stage 204 of the compressor. At least a portion of the discharged refrigerant can be passed to a cold box 214.

At least a portion 238 of the discharge can be passed back to the second stage 206 of the compressor 202. The second stage 206 of the compressor 202 can be configured to compress the gaseous portion 238 of the discharged refrigerant.

While this specific example is described relative to the first stage 204 of the multi-stage compressor 202, it is contemplated that any stage of a multi-stage compressor can have a discharge outlet whereby discharge is passed to a cooler and at least a portion of the discharge from any stage of a multi-stage compressor can be passed back to any downstream stage of a multi-stage compressor.

Figure 3:
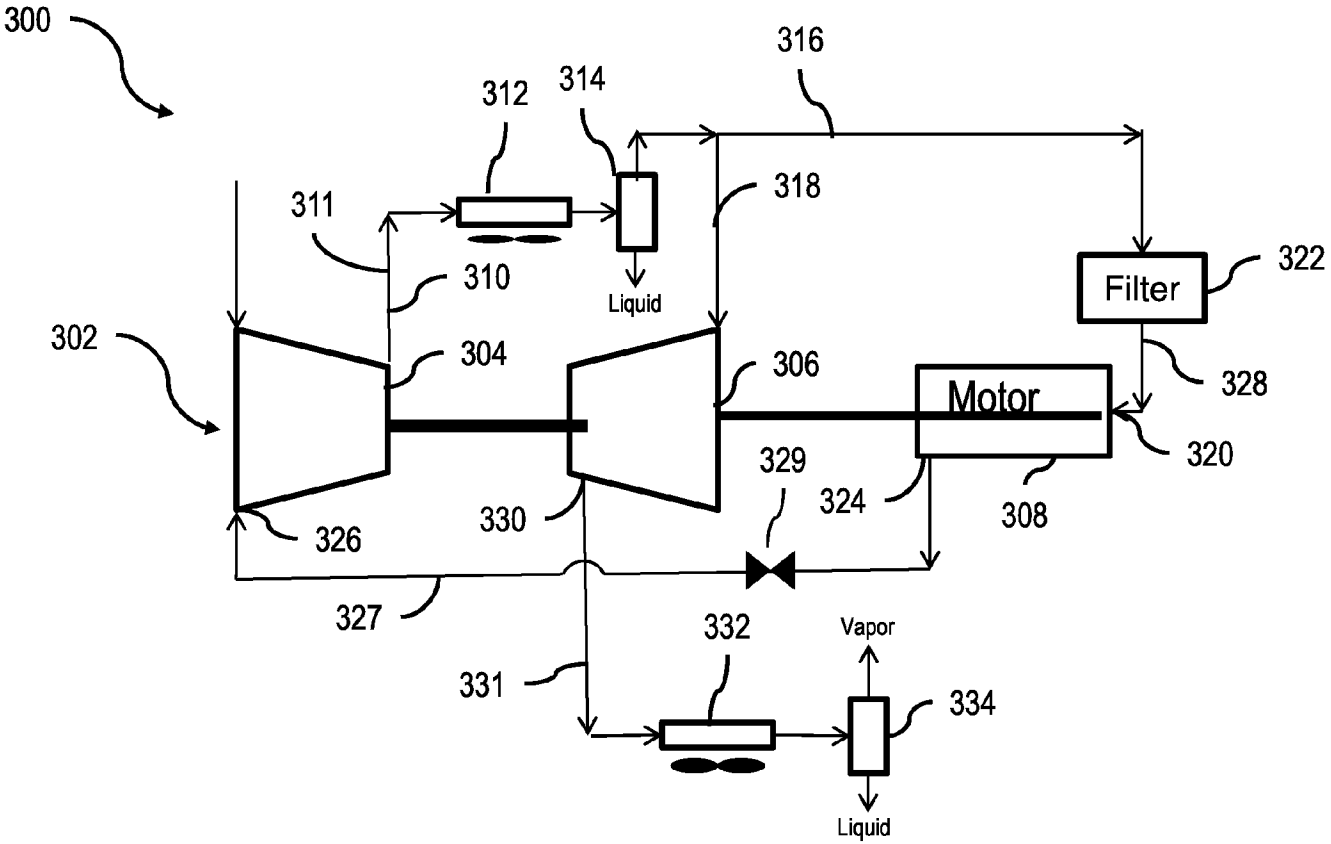
FIG. 3 is a schematic diagram of another embodiment of a gas processing system with a cooled motor.

FIG. 3 is a schematic diagram of another embodiment of a system 300 having a motor that is cooled. In some variations, one or more components of system 300 can be similar to one or more components of system 200. The compressor 302 can have a first stage 304 and a second stage 306. The system 300 can include a motor 308 for driving the compressor 302.

In some variations, the first stage 304 of the compressor 302 can include a discharge outlet 310. The first-stage discharged refrigerant 311 can include a vapor component and a liquid component. The first-stage discharged refrigerant 311 can be passed to a cooler 312. The cooler 312 can be configured to cool the first-stage discharge to a temperature in a range of about 3-55 degrees Celsius. The cooled first-stage discharge can be passed through a separator 314, which can be configured to separate the vapor component of the first-stage discharge from the liquid component of the first-stage discharge. The liquid component can be diverted to a cold box for downstream processing. At least a portion 316 of the vapor component of the first-stage discharge can be used as a gaseous coolant 328 to cool the motor 308. The remaining portion 318 of the vapor component of the first-stage discharged refrigerant 311 can be passed to the second stage 306 of the two-stage compressor 302 for further compressing.

The coolant can be passed into the motor 308 through a motor coolant inlet 320. The coolant, being at least a portion 316 of the vapor component of the first-stage discharged refrigerant 311, can be used to cool the motor 308 and/or maintain the temperature of the motor 308.

In some variations, the system 300 can include a filter 322 disposed between the separator 314 and the coolant inlet 320 of the motor 308.

The motor 308 can include a coolant outlet 324. The coolant outlet 324 can be configured to facilitate recirculation of discharged coolant, having gone through the motor 308 to cool the motor 308. The discharged coolant 327 can be routed to a first-stage inlet 326. The discharged coolant 327 can be compressed by the first stage 304 of the compressor 302.

In some variations, a valve 329 can be disposed between the coolant outlet 2324 of the motor 308 and the first-stage inlet 326. The valve 329 can be configured to cool the coolant discharged from the coolant outlet 324.

The second stage 306 of the compressor 302 can include an outlet 330 configured to facilitate the discharge of compressed refrigerant 331 from the compressor 302. The discharged compressed refrigerant 331 can be routed through a cooler 332. The cooler 332 can be a water cooler, air cooler, or the like. The cooler 332 can be accompanied by a separator 334. The separator 334 can be configured to separate a vapor component of the discharged compressed refrigerant 331 and a liquid component of the discharged compressed refrigerant 331 from the discharged compressed refrigerant 331.

Figure 4:
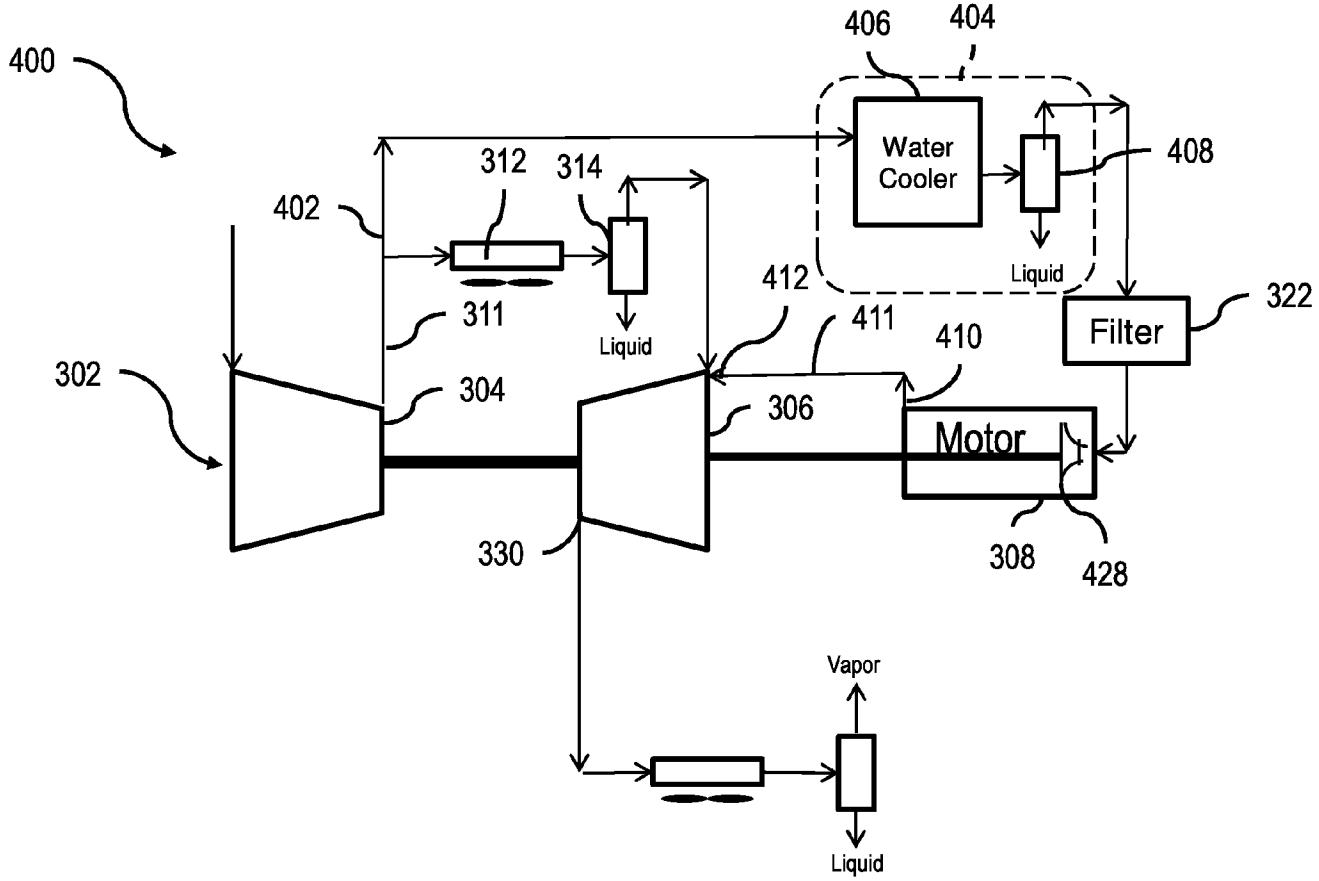
FIG. 4 is a schematic diagram of yet another embodiment of a gas processing system with a cooled motor.

FIG. 4 is a schematic diagram of another embodiment of a system 400 having a cooled motor. The system 400 can largely have one or more components similar to one or more components of system 300.

In some variations, only a portion of the discharged refrigerant 311 from the first stage 304 of the compressor 302 is passed to the cooler 312 and the separator 314. This portion may have a temperature, pressure, and/or state different from the rest of the discharge from the first stage 304 of the compressor 302. A remaining portion 402 can be routed to a cooler 404. The cooling unit 404 can include a cooler 406, which can be an air cooler, water cooler, or the like. The cooling unit 404 can include a separator 408 that can be configured to separate out a gaseous component from a liquid component of the remaining portion 402 of the discharged refrigerant 311 from the first stage 304 of the compressor 302. The liquid component can be routed to a cold box for downstream processing. The gaseous component can be treated to become a coolant for the motor. Treatment can include filtering by the filter 322.

In some variations, the system 400 can include a low pressure drop cooling unit 404 configured to regulate the pressure of the coolant for the motor 308, so that the motor 308 need not have a fan 428 for pressure regulation. Consequently, the heat produced by the fan 428 need not be accounted for when cooling the motor 308.

In some variations, the motor 308 can include a coolant discharge outlet 410. The coolant discharge 411 can be spent coolant that has been used to cool the motor 308. The discharged coolant can be routed to an inlet 412 of the second stage 306 of the compressor 302. The compressor 302 can then compress the discharged coolant. The compressed discharged coolant 411 can be comingled with, and can become part of, the compressed refrigerant produced by the compressor 302 discharged through outlet 330 of the second stage 306 of the compressor 302.

In some variations, the motor 308 can include a fan 428 which can be configured to increase a pressure of the coolant 402 for cooling the motor 308. The fan can be disposed in-line before the motor 308, in the motor 308, or the like. A first discharge 402 from the first stage 304 of the compressor 302 has a pressure that is only slightly higher than the inlet pressure of the second stage of the compressor 306. Consequently, the gaseous coolant 402 may have insufficient pressure to optimally cool the motor 308. The fan 428 can be used to increase the pressure of the coolant to a desired level. The fan 428 can be disposed on the same shaft as the drive axle of the motor 308. In some variations, the temperature of the coolant entering the motor 308 can be set sufficiently low to account for the heat imparted to the coolant by the fan 428. Where the pressure rise is small, the fan 428 may be sufficient and a compressor may not be required to raise the pressure of the coolant. The fan 428 may be necessary if the motor 308 is pressurized at the suction pressure of the second stage 306 of the compressor 302 to improve the cooling of the motor 308. The fan 428 can be configured to overcome the pressure drop in the filter 322 and motor 308 and to ensure that the motor 308 is cooled by the coolant. The desired flow can be circulated inside the motor 308 and the gas can be transferred to the proper location either at the first stage 304 of the compressor 302 or at the second stage 306 of the compressor 302 to optimize the energy used to cool the motor 308.

Figure 5:
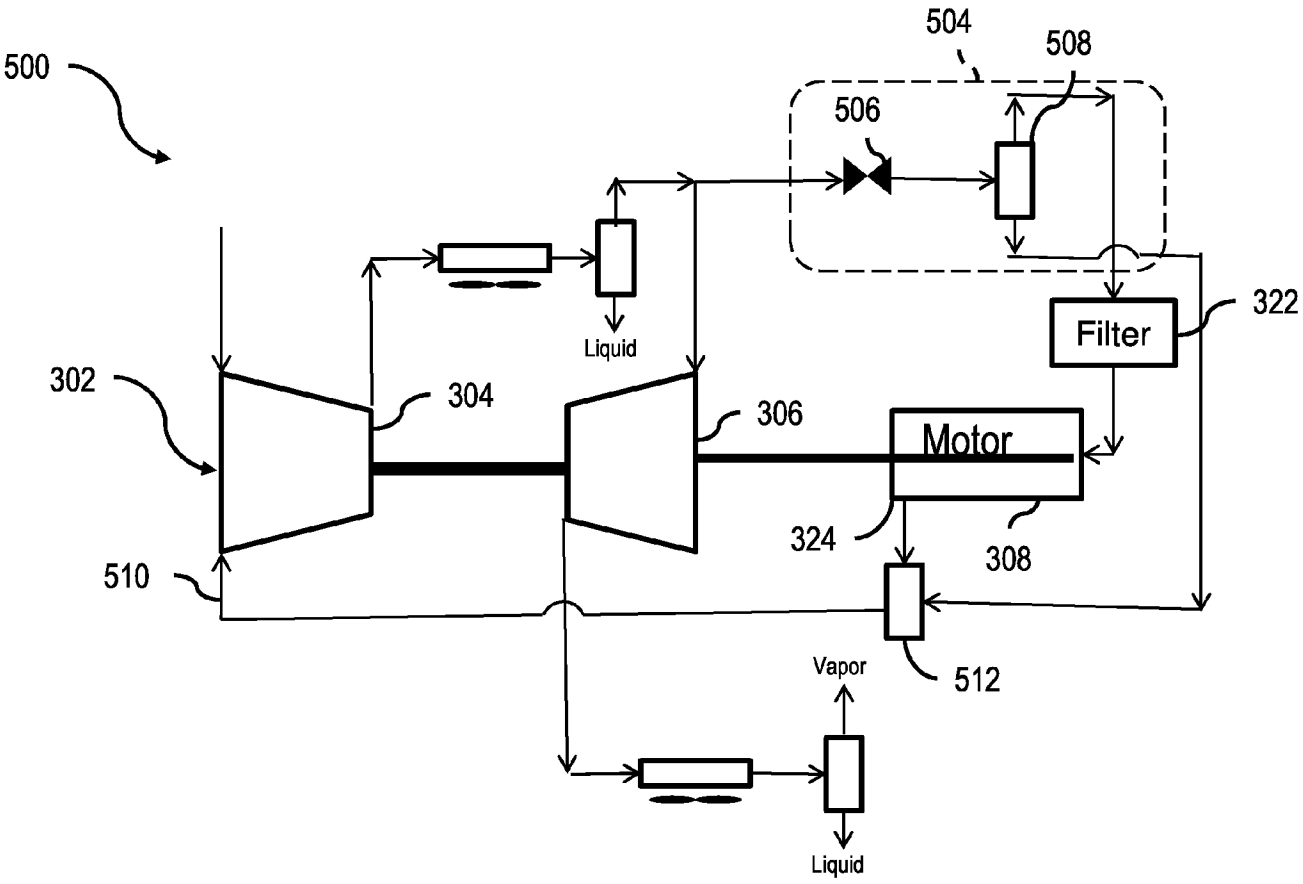
FIG. 5 is a schematic diagram of another embodiment of a gas processing system with a cooled motor.

FIG. 5 is a schematic diagram of another embodiment of a system 500 with a cooled motor. One of more of the components of system 500 can be largely similar to one or more components of system 300.

System 500 can include a cooling unit 504. The cooling unit 504 can include a valve 506, such as a Joule-Thomson valve. A separator 508 can accompany the valve 506 and it can be configured to separate a vapor, or gaseous, component from a liquid component of the discharge from the first stage 304 of the compressor 302. The gaseous component can be routed, as a coolant, to the motor 308, as described with respect to FIG. 3.

The liquid component from the cooler 504 can be routed to a mixer 512 prior to introduction to a stage 304 of the compressor 302.

The used coolant discharged by the motor 308 can be routed to the inlet 510 of the first stage 304 of the compressor 302. In some variations, the system 500 can include a mixer 512 configured to facilitate mixing of the used coolant discharged by the motor 308 and the liquid component from the cooler 504 prior to being introduced into the first stage 304 of the compressor 302 through the inlet 510. The discharge from the motor 308 vaporizes the liquid in the mixer 512.

Figure 6:
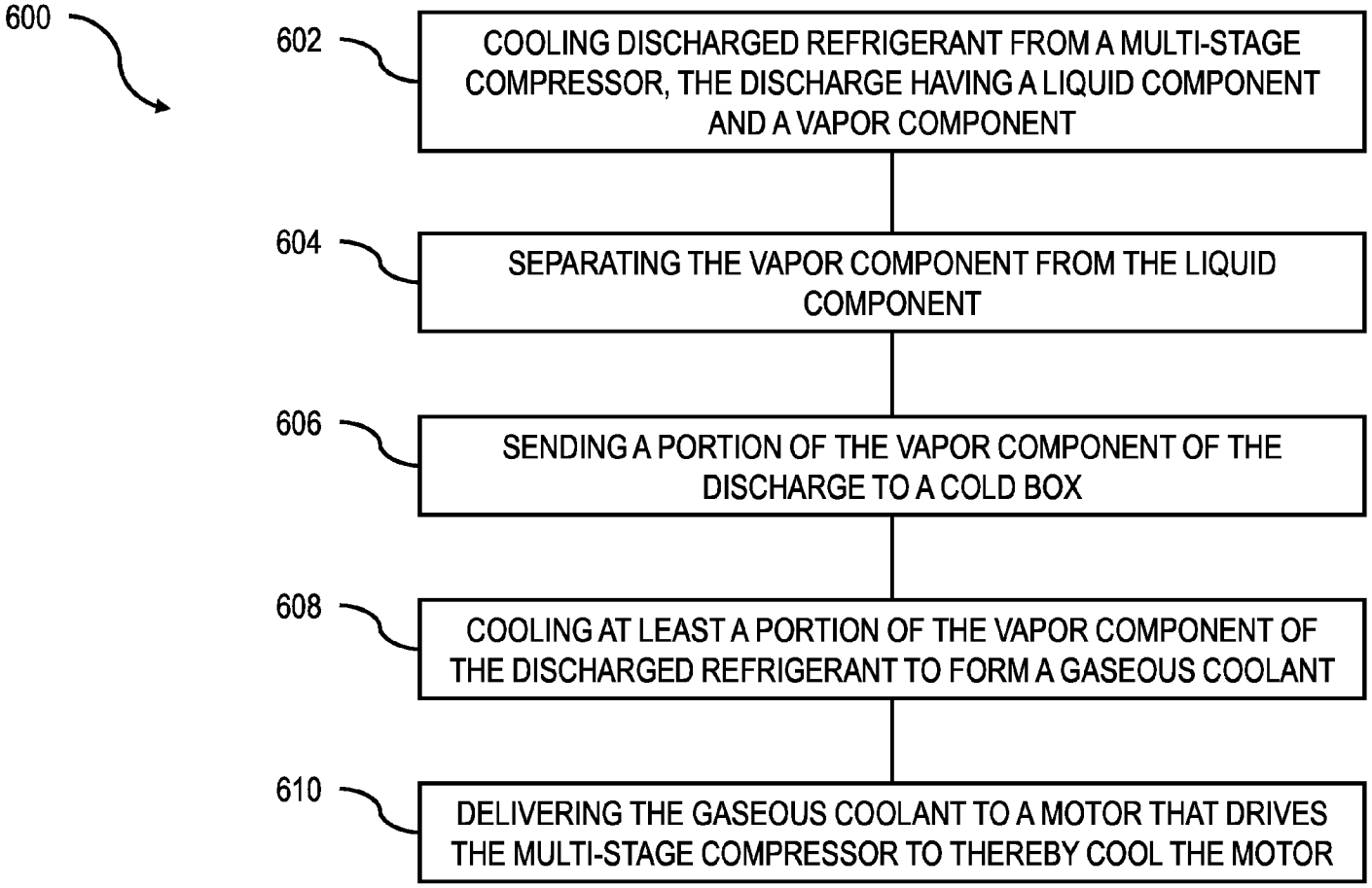
FIG. 6 is a process flow diagram illustrating a method for cooling a motor in a gas processing system.

FIG. 6 is a process flow diagram illustrating a method 600 for cooling a motor in a gas compression processing system. By way of non-limiting example, FIG. 6 illustrates one exemplary method of use of the system of FIG. 2. In operation, refrigerant from the cold box enters the inlet port 211 of the first stage 204 of the multi-stage compressor 202 and is compressed to a range of 10-150 bar in the multi-stage compressor 202. The compressed refrigerant then exits the outlet port 216 of the last stage 206 of the multi-stage compressor 202 and enters a cooler 210. The cooler 210 lowers the temperature of the compressed refrigerant to a range of about 3-55 degrees Celsius. The compressed refrigerant simultaneously, or consecutively, enters a separator 212 that separates vapor components and liquid components from the compressed refrigerant. The liquid component of the compressed refrigerant can be diverted to a cold box 214 for down-stream processing.

At least a portion of the vapor component of the compressed refrigerant can be used as the gaseous coolant 228 for cooling the motor. From the separator 1226, the gaseous coolant 228 can flow to the piping system that routes the cooling gas to internal passages to cool the coils and the rotor of the motor 208. The passages within the coils, and the surfaces on the coils' side, and the rotor side that create a gas gap, transfer excess heat generated by operation of the motor 208 to the gaseous coolant 228, thereby cooling the motor 208, which improves its operating efficiency and extends its life, reducing maintenance, or the like. The slightly heated gaseous coolant 228 flows through coolant outlet 232 and, in some cases, can enter the second stage 204 of the compressor 202.

As shown in FIG. 6, at 602, discharged refrigerant from a multi-stage compressor can be cooled. The discharged refrigerant can have a liquid component and a vapor component.

At 604, the vapor component of the discharged refrigerant can be separated from the liquid component. In some variations, the liquid component of the discharged refrigerant can be sent to a cold box. The liquid component of the discharged refrigerant can be mixed refrigerant.

At 606, a portion of the vapor component of the discharged refrigerant can be sent to a cold box.

At 608, at least a portion of the vapor component of the discharged refrigerant can be cooled to form a gaseous coolant. Cooling the at least a portion of the vapor component of the discharge to form the gaseous coolant can include cooling the at least a portion of the vapor component of the discharged refrigerant to a temperature in a range of about 3-55 degrees Celsius.

At 610, the gaseous coolant can be delivered to a motor that drives the two-stage compressor to thereby cool the motor.

Figure 7:
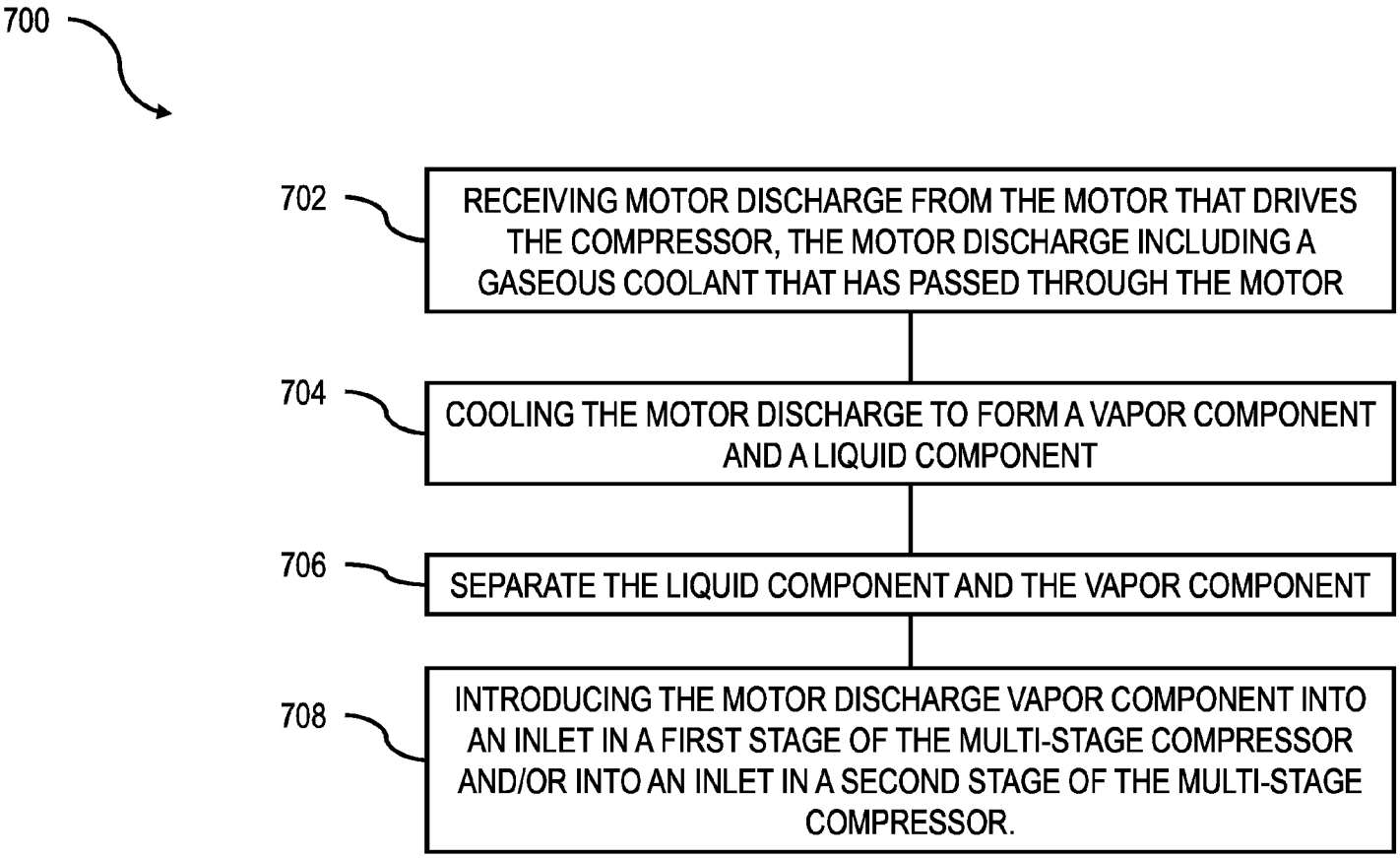
FIG. 7 is a process flow diagram illustrating another embodiment of a method for cooling a motor in a gas processing system.

FIG. 7 is a process flow diagram illustrating another method 600 for cooling a motor in a gas compression processing system.

At 702, motor discharge can be received from the motor that drives the compressor. The motor discharge can include a gaseous coolant that has passed through the motor.

At 704, the motor discharge can be cooled to form a vapor component and a liquid component.

At 706, the liquid component and the vapor component can be separated. In some variations, the liquid component of the motor discharge can be sent to a cold box.

At 708, the vapor component of the motor discharge can be introduced into an inlet in a first stage of the two-stage compressor, and/or introduced into an inlet in a second stage of the two-stage compressor.

The operations described in relation to FIGS. 6 and 7 are not intended to be limiting. A method for cooling a motor can include the operations shown, one or more additional operations, one or more fewer operations, or the like. The operations described with respect to FIGS. 6 and 7 can be performed by one or more components as described herein, or one or more other components. The methods 600 and 700 can any of the aforementioned operations and suitable combinations of various elements of the method.

Certain exemplary embodiments are described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting exemplary embodiments and that the scope of the presently described subject matter is defined solely by the claims. In the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. The features illustrated or described in connection with one exemplary embodiment may be combined with the features of other embodiments. Such modifications and variations are intended to be included within the scope of the presently described subject matter.

This written description uses examples to disclose the subject matter, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system, comprising:

a compressor having a plurality of stages, the compressor being configured to compress a refrigerant in a first stage and a second stage of the plurality of stages and discharge the compressed refrigerant from the first and/or the second stage of the plurality of stages;

a motor coupled to the compressor to drive the compressor; and a cold box positioned downstream from the first stage, the cold box configured to condense the compressed refrigerant discharged by the first stage and output the compressed refrigerant to the second stage;

wherein the system is configured to cool, via the cold box, portions of the compressed refrigerant discharged from the second stage, to separate, via a separator coupled to the second stage, at least a vapor portion from the compressed refrigerant discharged by the second stage, and to output from the separator, the vapor portion as a gaseous coolant to cool the motor.

2. The system of claim 1, further comprising an after cooler coupled with the second stage of the compressor and configured to cool a liquid portion and the vapor portion from the compressed refrigerant discharged from the second stage.

3. The system of claim 2, wherein the after cooler is configured to cool the liquid portion and the vapor portion of the compressed refrigerant discharged from the second stage to a temperature in a range of about 3-55 degrees Celsius.

4. The system of claim 1, wherein the cold box is configured to condense a feedgas using the at least the vapor portion of the compressed refrigerant discharged by the second stage.

5. The system of claim 1, further comprising a motor discharge cooler or joule Thompson valve configured to cool the at least the vapor portion of the compressed refrigerant discharged by the second stage.

6. The system of claim 1, wherein a Joule Thompson valve or water cooler is used to cool the at least a portion of the vapor output from the separator to the motor.

7. The system of claim 1, wherein the system is configured to simultaneously cool the portion of the compressed refrigerant discharged from the second a stage of the compressor and to separate the vapor portion of the compressed refrigerant discharged from the second stage.

8. A method for cooling a motor coupled to and driving a compressor having a plurality of stages, including a first stage and a second stage, the method comprising:

cooling, via a cold box positioned downstream from the first stage and the motor, at least a portion of a compressed refrigerant discharged from the first stage of the compressor, the compressed refrigerant having a liquid component and a vapor component;

outputting the cooled portion of the compressed refrigerant to the second stage of the plurality of stages;

separating, via a separator coupled to the second stage, at least a portion of the vapor component of the compressed refrigerant from the liquid component of the compressed refrigerant discharged by the second stage; and delivering the at least a portion of the vapor component of the compressed refrigerant from the separator, to the motor that drives the compressor to thereby cool the motor.

9. The method of claim 8, further comprising sending at least a portion of the liquid component of the compressed refrigerant to the cold box.

10. The method of claim 8, wherein cooling the at least a portion of the compressed refrigerant comprises cooling at least a portion of the vapor component of the compressed refrigerant to a temperature in a range of about 3 degrees to about 55 degrees Celsius.

11. The method of claim 8, further comprising:

receiving motor discharge from the motor that drives the compressor, the motor discharge including at least a portion of the vapor component, of the compressed refrigerant, delivered to the motor;

cooling the motor discharge; and sending at least a portion of the cooled motor discharge to the cold box.

12. The method of claim 8, further comprising:

receiving motor discharge from the motor that drives the compressor, the motor discharge including at least a portion of the vapor component provided to the motor; and introducing at least a portion of the motor discharge into a stage of the plurality of stages of the compressor.

13. The method of claim 8, wherein cooling the portion of the compressed refrigerant discharged from the second stage of the compressor and separating the vapor portion from the of the compressed refrigerant discharged from the second stage occurs simultaneously.

14. The method of claim 8, wherein the cooling of at least a portion of the vapor component of the compressed refrigerant is performed by a Joule Thompson valve or water cooler.

* * * * *